US011710613B2

(12) United States Patent
Wilhelm et al.

(10) Patent No.: US 11,710,613 B2
(45) Date of Patent: Jul. 25, 2023

(54) MELTING CONDUCTOR AND FUSE

(71) Applicant: SIBA Fuses GmbH, Lünen (DE)

(72) Inventors: Dirk Wilhelm, Lünen (DE); Jens Weber, Dortmund (DE); Johannes-Georg Gödeke, Lünen (DE)

(73) Assignee: SIBA Fuses GmbH, Lünen (DE)

( * ) Notice: Subject to any disclaimer, the term of this patent is extended or adjusted under 35 U.S.C. 154(b) by 0 days.

(21) Appl. No.: 17/278,705

(22) PCT Filed: May 18, 2020

(86) PCT No.: PCT/EP2020/063868
§ 371 (c)(1),
(2) Date: Mar. 23, 2021

(87) PCT Pub. No.: WO2020/259924
PCT Pub. Date: Dec. 30, 2020

(65) Prior Publication Data

US 2022/0068581 A1 Mar. 3, 2022

(30) Foreign Application Priority Data

Jun. 25, 2019 (DE) ..... 10 2019 004 418.5
Aug. 13, 2019 (DE) ..... 10 2019 005 664.7

(51) Int. Cl.
*H01H 85/055* (2006.01)
*H01H 85/042* (2006.01)
*H01H 85/165* (2006.01)

(52) U.S. Cl.
CPC ..... *H01H 85/042* (2013.01); *H01H 85/055* (2013.01); *H01H 85/165* (2013.01)

(58) Field of Classification Search
CPC .... H01H 85/042; H01H 85/055; H01H 85/12; H01H 85/165; H01H 85/185
See application file for complete search history.

(56) References Cited

U.S. PATENT DOCUMENTS 3,601,737 A * 8/1971 Baird ..... H01H 85/055 337/159
3,766,509 A 10/1973 Cameron
(Continued)

FOREIGN PATENT DOCUMENTS

EP 3270403 A1 1/2018
FR 2958073 A1 9/2011
(Continued)

OTHER PUBLICATIONS

International Search Report for International Application No. PCT/EP2020/063868, dated Sep. 1, 2020.
(Continued)

*Primary Examiner* — Jacob R Crum
(74) *Attorney, Agent, or Firm* — Jason H. Vick; Sheridan Ross, PC

(57) ABSTRACT

The invention relates to an use of a melting conductor (1) for a DC fuse (2) and a high-voltage high-power fuse (2) (HH-DC fuse), wherein the melting conductor (1) comprises an electrically conductive melting wire (3), wherein the melting wire (3) comprises at least two overload narrow sections (4) in the form of a cross-sectional constriction, wherein, preferably between the two immediately successive overload narrow sections (4) a first layer (7) comprising solder and/or surrounding the outer shell surface (6) of the melting wire (3) circumferentially at least in some areas, preferably completely, is provided in at least one first section (5), and wherein a second layer (9) surrounding the outer shell surface (6) of the melting wire (3) circumferentially at least in some areas, preferably completely, is provided adjacent to each of the overload narrow sections (4) in a respective second section (8).

25 Claims, 6 Drawing Sheets

(56) References Cited

U.S. PATENT DOCUMENTS

Figure 1:
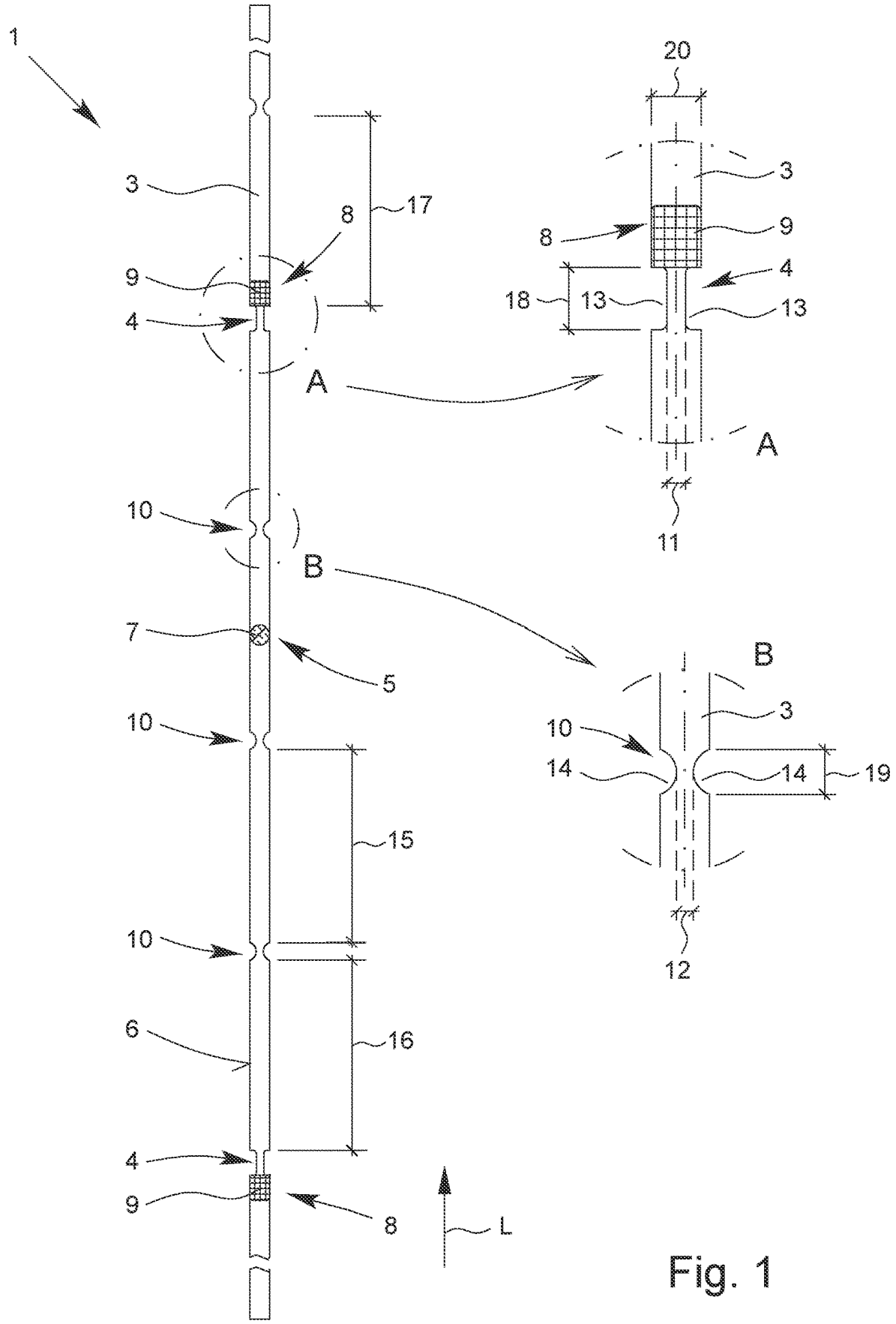

| | | | | | |
|---|---|---|---|---|---|
| 3,835,431 | A * | 9/1974 | Rosen | H01H 85/10 | 337/159 |
| 4,032,879 | A * | 6/1977 | Monagan | H01H 85/42 | 337/281 |
| 4,134,094 | A * | 1/1979 | Huber | H01H 85/46 | 337/159 |
| 4,308,515 | A * | 12/1981 | Rooney | H01H 85/055 | 337/292 |
| 4,654,620 | A * | 3/1987 | Rooney | H01H 85/10 | 337/296 |
| 5,892,427 | A | 4/1999 | Handcock | | |
| 2003/0076214 | A1* | 4/2003 | Ackermann | H01H 85/38 | 337/296 |
| 2018/0159360 | A1* | 6/2018 | Enthaler | H02M 7/217 | |
| 2020/0035437 | A1* | 1/2020 | Gaudinat | H01H 9/106 | |

FOREIGN PATENT DOCUMENTS

| | | |
|---|---|---|
| GB | 1326535 A | 8/1973 |
| WO | WO 2015/183805 | 12/2015 |

OTHER PUBLICATIONS

Written Opinion for International Application No. PCT/EP2020/063868, dated Sep. 1, 2020.
International Preliminary Report on Patentability for International Application No. PCT/EP2020/063868, dated Feb. 23, 2021.

* cited by examiner

MELTING CONDUCTOR AND FUSE

CROSS-REFERENCE TO RELATED APPLICATIONS

This application is a national stage application under 35 U.S.C. 371 of PCT Application No. PCT/EP2020/063868 having an international filing date of 18 May 2020, which designated the United States, which PCT application claimed the benefit of German Patent Application No. 10 2019 004 418.5, filed 25 Jun. 2019 and German Patent Application No. 10 2019 005 664.7. filed 13 Aug. 2019, each of which are incorporated herein by reference in their entirety.

The invention relates to the use of a melting conductor for a high voltage high power fuse for a direct current application (HH-DC fuse/Direct Current fuse). Furthermore, the present invention relates to a fuse for a direct current application.

The energy supply of the next years and/or decades will be subject to a drastic structural change. This energy change and especially the German "Energiewende" will be influenced by the impact of renewable energies. The increasing share of renewable energies in the energy supply requires a restructuring of the energy supply system.

Energy production is becoming increasingly decentralized, wherein this is under the influence of renewable energy installations (RE installations). Many renewable energy installations generate a direct current that is subsequently fed into an associated grid, especially a distribution grid.

For the safe use of a direct current network, which is fed for example by renewable energy installations, a permanent protection of the direct current and/or the direct current application is necessary.

A fuse protection for the direct current is not only required for distribution networks fed by renewable energy installations, but also in principle for distribution networks that operate with direct voltage. The current market practice is alternating current transmission and/or an alternating current grid. However, this will change in the coming years to decades.

The reason for this is that, from a technical point of view, direct current transmission is preferably used to transmit electricity over comparatively long distances with regard to reduced transmission loss. Therefore, especially a high-voltage direct-current (HVDC) connection and/or a medium-voltage direct-current (MVDC) connection is suitable for connecting offshore installations. Such a power transmission takes place at the transmission level. However, in order to connect the consumers and especially the households, a transfer from the transmission level to the distribution level takes place. The distribution level, which receives the direct current from the transmission level, must also be permanently secured under high technical requirements.

Restructuring the grid from AC voltage to DC voltage accordingly poses the challenge of fusing the DC voltage at the distribution level so that households and/or electrical consumers and/or energy installations, especially renewable energy installations, can be safely connected to the DC distribution grid.

Also for the integration of electric vehicles and/or the integration of power plants and decentralized power generators, an efficient and secure fuse protection of the DC distribution grid is a decisive factor in the overall implementation of the energy transition and/or the restructuring of the energy market.

One of the greatest challenges here is the fuse of the direct current grid and/or the direct current application. Without such a fuse protection, the concepts for DC transmission and, in particular, for the decentralization of power generation and the feed-in of decentralized power plants and/or energy installations cannot be implemented. DC fuses for DC applications, especially at the distributor grid level, are thereby a technical anchor point of safe grid operation.

However, the disadvantage of current DC applications is that in practice—if at all—only inadequate to at best sufficient fuse protection of the DC transmission and/or the DC application can be guaranteed. Especially for DC applications on the distribution network level, there are no known fuses that can withstand the long-term load of DC transmission and also safely switch off the transmitting DC current in the event of a short circuit. Consequently, direct currents cannot be effectively fused, especially in sections and/or in a compact design comprising small dimensions and/or a short length.

However, not only switching off in the event of a short circuit, but also switching off in the event of an overload (overload circuit) is required for long-term fuse protection of the DC application. Overload currents are currents which exceed the rated value of the consumers connected in the DC distribution system, especially the equipment, an installation, cables and/or lines, without there being a short circuit.

A fuse for a DC high voltage that simultaneously provides overload and short-circuit protection is not known in the prior art. However, this would be necessary for safe operation of the DC distribution network and the DC transmission line. Without overload protection, it is not possible to prevent heating of the consumers to be protected, such as drive equipment, cables and/or lines, during continuous operation. Thus, the consumers are exposed to high thermal and mechanical stresses in the event of an overload and/or during a short circuit.

Fuses for use in DC circuits are known in the prior art for the low-voltage range. However, these are not suitable and/or usable for the high-voltage and/or medium-voltage DC range. EP 3 270 403 A1, for example, relates to such a low-voltage fuse for a DC voltage circuit.

The object of the present invention is now to avoid the aforementioned disadvantages in the prior art, or at least to substantially reduce them.

According to the invention, the aforementioned object is solved by a use of a melting conductor for a DC fuse (a fuse for DC transmission) and a high voltage high power fuse (the so-called HH-DC fuse). The melting conductor comprises an electrically conductive melting wire. The melting wire comprises at least two overload narrow sections formed as cross-sectional constrictions. In at least one first section, a first layer is provided which circumferentially surrounds the outer shell surface of the melting wire at least in some areas, preferably completely. The first layer comprises solder as a material and/or consists thereof. Preferably, the at least one first section is provided between the two immediately successive overload narrow sections. Adjacent to each of the overload narrow sections, a second layer surrounding the outer shell surface of the melting wire circumferentially at least in some areas, preferably completely, is provided in a second section.

According to the invention, the melting wire is not fixed and/or limited to a specific geometric shape and/or to a specific cross-sectional shape. Especially, the melting wire is not limited to a circular and/or elliptical cross-sectional shape. Preferably, the melting wire may be designed as a flat wire and/or flat strip. Alternatively or additionally, it may be provided that the melting wire is designed to be at least substantially cylindrical and/or comprises an at least substantially circular cross-sectional shape.

Especially the first layer is designed to be electrically conductive and/or the second layer is designed to be electrically insulating.

More preferably, the overload narrow sections are arranged in succession extending in the longitudinal direction of the melting wire. When used in a DC fuse, the melting conductor enables a DC current to be switched off in a very short time frame, especially between 10 ms to 1 second. Even more preferably, overload disconnection can occur for up to one hour.

The entire melting conductor preferably comprises only a single first section comprising the first layer, which is preferably arranged at least essentially in the middle of the length of the melting conductor.

Alternatively or additionally, it may be provided that a plurality of first sections comprising the first layer are provided.

Especially, the arrangement of the first section may be provided independently of the arrangement of the overload narrow sections.

According to the invention, it has been found that the minimum breaking current can be significantly reduced by arranging the overload narrow sections in combination with the first and second layers. This ultimately enables the use of the melting conductor in high voltage DC fuses, which can be used for both short-circuit disconnection and overload disconnection. Short-circuit protection can be enabled by the fuse in that the largest short-circuit currents can be safely interrupted at their point of installation. In turn, the overload protection can be provided by the first layer in a current-dependent manner, wherein the breaking capacity for the overload protection can in principle be smaller than the short-circuit current at the fuse installation point.

The use of further means to protect a DC application and especially to ensure overload protection can be avoided. Further switch-disconnectors or the like are not required and/or such a requirement is reduced. According to the invention, a DC transmission network can be efficiently secured. Furthermore, according to the invention, it can be used as back-up protection, especially without the need for feed of energy, especially external energy, for actuation.

According to the invention, high DC currents and/or high DC voltages can be protected by the melting conductor used in the fuse. The minimum breaking current, which can also be referred to as the smallest breaking current, can thereby be held very low.

The smallest breaking current is the rated value of the minimal breaking current Above this current level, the fuse is capable of switching the overcurrent. Consequently, the electrical components (consumer, direct current source, etc.) must be arranged and/or designed on the fuse in such a way that no overcurrent can occur at the point of installation of the fuse that falls below the minimum breaking current. The smallest breaking current can depend on the selected design of the fuse.

In addition, the length of the melting conductor required for a HH-DC fuse can be drastically reduced by arranging the second layer according to the invention. The length of the melting conductor required for a HH-DC fuse can depend especially on the rated voltage of the fuse. Preferably, the arrangement according to the invention can reduce the length of the melting conductor by at least 10%, preferably 20%, further preferably 30%.

According to the invention, it is possible to disconnect comparatively low currents of the direct current at a high direct voltage. This is particularly necessary for a wide range of applications and for a safety to be guaranteed over a "wide" current range.

During the course of the invention, it was surprisingly found that the design of the melting conductor according to the invention makes the fuse comprising the melting conductor particularly suitable for a DC application, especially for the fuse protection of a DC distribution network. Thus, high DC currents and/or high DC voltages can be secured. As previously explained, no fuse is known in the prior art that can secure a DC application, especially in the high-voltage and high-power range. Especially the fuse in the medium voltage and/or high voltage range is associated with a large number of constraints and standards to be complied with. A high degree of sensitivity and caution with regard to the potential dangers resulting from high stresses and/or currents has meant that fuses have not been used "indiscriminately" and/or at all for the transmission and/or distribution of different types of current. In particular, there has not been a sufficient solution for DC transmission because of the anticipated problems.

Indeed, if one of the consumers and/or loads electrically connected to the DC distribution network were to cause a short circuit and/or comprise an overload, the entire DC network would fail—at least after a certain time. Even if no failure of the DC network is caused directly, high thermal and/or mechanical loads on the connected consumers and/or loads cannot be prevented. Accordingly, in practice, fuses in DC networks and/or DC distribution and/or DC transmission have been abandoned because the fuse protection required for a stable and safe power network and/or DC circuit could not be guaranteed on a permanent basis.

Surprisingly and not predictably, however, it has been found according to the invention that the special melting conductor according to the invention can be used in a high voltage fuse and/or in a fuse for a DC application, wherein the necessary safety can be ensured, especially in case of overload and short circuit. It was found that in the event of an overload and also in the event of a short-circuit, damage to the fuse box of the fuse, especially the high voltage fuse, possibly connected with an escape of extinguishing agent and/or with an arc leakage, can be prevented. In simulated long-term tests it has been established that even in the case of long-term use of the fuse comprising the melting conductor according to the invention for fuse protection of a DC application, for example for a period of more than five years, preferably more than ten years, even more preferably more than 15 years, the required safety guidelines and/or regulations, especially those prescribed by law, can be complied with. Especially the fuse comprising the melting conductor according to the invention can be used maintenance-free.

Thus, according to the invention, a fuse can be provided which can be used for a direct current application in the medium voltage and/or high voltage level. Especially the melting conductor according to the invention makes it possible to connect a plurality of consumers and/or generators (for example renewable energy installations) to the DC link and/or to the DC circuit, which are protected by at least one fuse comprising the melting conductor. If a consumer fails, especially in the event of a short circuit, the DC grid does not break down. This especially ensures the security of supply.

Preferably, a sectional fuse protection of the DC network can be carried out by means of the fuse comprising the melting conductor according to the invention.

Due to the melting conductor, the fuse comprising the melting conductor is designed as a safety fuse. The safety fuse is an overcurrent protection device which interrupts the circuit by melting the melting conductor when the current exceeds a certain value for a sufficient time. Preferably, the time required to switch the fuse is very short, especially in the millisecond range.

In principle, the melting conductor can also be used in a fuse for switching off alternating current (AC fuse/alternating current fuse). Ultimately, however, this use is not indicated due to oversizing—achieved according to the invention—for the alternating current. Especially the melting conductor according to the invention is not technically necessary when used in a fuse for the protection of alternating current transmission.

In relation to its length, the melting conductor provides a relatively high resistance compared to the rest of the network, especially the DC distribution network, which leads to heating in rated operation and to melting through in the event of an overload and/or short circuit.

By designing the cross-sectional constrictions in combination with the first and second layers, the behavior of the melting conductor can be influenced in accordance with the invention in such a way that the melting conductor is suitable for fuse protection of a DC transmission, especially in the high-voltage range.

In addition, the melting conductor can be designed in such a way that it can be operated permanently at higher temperatures compared with low-voltage fuses.

The behavior of the melting conductor in the overload range can be advantageously influenced by the overload narrow sections. Especially preferably, the overload narrow sections are finally designed to be elongated, especially by punching by means of angular punches, so that a faster or slower response can be set by the length of the cross-sectional constriction and by the "web width" (width of the cross-sectional constriction).

The first layer can also be applied to the melting wire and/or to the outer surface of the melting wire circumferentially only in certain areas, in particular only on the top and/or underside of a melting wire formed as a flat strip. Thereby, the first layer can design an at least essentially elliptical, preferably circular, first section—seen in cross-section.

Preferably, the second layer is formed in the second section in such a way that it at least substantially completely surrounds the melting wire (at least in the second section) circumferentially. Thereby, the second layer may comprise an at least substantially annular and/or hollow-cylindrical shape. Preferably, the second layer and the second section are directly adjacent to the overload narrow section, so that the overload narrow section, which is formed as a cross-sectional constriction, adjoins the second section at least substantially immediately afterwards. Preferably, however, the second section does not extend into the region of the overload narrow section comprising the reduced cross section.

Especially the first section can be provided at least substantially centrally between the second sections and/or between the immediately successive overload narrow sections.

Alternatively or additionally, a single first layer is especially preferably provided in the first section for each melting conductor in a first embodiment, the arrangement of which layer is especially independent of the cross-sectional constrictions and/or is especially present at least substantially centrally of the melting conductor. In further embodiments, at least two first layers can be provided per melting conductor, wherein the first section comprising the first layer can be arranged independently of the cross-sectional constrictions and/or centrally—as viewed in the longitudinal direction of the melting wire—on the melting wire.

In a particularly preferred embodiment, it is provided that the melting wire comprises at least one short-circuit constriction in the form of a cross-sectional constriction between two directly successive overload narrow sections. The short circuit narrow section especially enables the fuse comprising the melting conductor according to the invention to be switched in the event of a short-circuit.

Preferably, the minimum width and/or the shape of the cross-sectional constriction of the overload narrow section differs from the minimum width and/or the shape of the cross-sectional constriction of the short circuit narrow section.

Alternatively, the minimum width and/or the shape of the cross-sectional constriction of the overload narrow section may correspond at least substantially to the minimum width and/or the shape of the cross-sectional constriction of the short circuit narrow section.

According to the invention, the provision of the at least one short circuit narrow section can enable the fuse to react quickly, especially in the event of a short-circuit. According to the design of the short circuit narrow section, a more rapid or a less rapid short-circuit behavior can be set. The level of forward current during the short circuit can also be significantly adjusted by the minimum width and/or the narrow section width of the short circuit narrow section.

Preferably, according to the invention, the minimum width of the cross-sectional constriction of the overload narrow section is greater than the minimum width of the cross-sectional constriction of the short circuit narrow section. This enables the fuse comprising the melting conductor to switch both in the short-circuit case and in the overload case, since a different design of the cross-sectional constrictions of the short circuit narrow section and the overload narrow section can ensure a corresponding fuse behavior for short-circuit disconnection in each case.

Eventually, it is understood that the cross-sectional constriction of the overload narrow section and/or the short circuit narrow section does not have to comprise a constant width. The minimum width of the cross-sectional constriction is to be understood as the smallest width in each case.

In the course of the invention, it has been found that the ratio of the minimum width of the cross-sectional constriction of the overload narrow section to the minimum width of the cross-sectional constriction of the short circuit narrow section is between 0.01:1 and 3:1, preferably between 1.1:1 and 2:1, even more preferably between 1.15 and 1.5:1. The above ratios ensure in particular that overcurrent protection is provided both in the event of a short circuit and in the event of an overload by switching off the current, especially the direct current.

Alternatively or additionally, it can be provided that the minimum width of the cross-sectional constriction of the overload narrow section is between 0.3 and 1.5 mm, preferably between 0.4 and 1 mm, even more preferably between 0.5 and 0.7 mm, and in particular at least essentially 0.6 mm.

The minimum width of the cross-sectional narrowing of the short circuit narrow section can be between 0.25 to 1.3 mm, preferably between 0.4 to 1 mm, even more preferably between 0.5 to 0.6 mm, and in particular at least substantially 0.5 mm. A ratio of the minimum width of the cross-sectional constriction of the overload narrow section to the minimum width of the cross-sectional constriction of the short circuit narrow section of 0.6:0.55—that is, of approximately 1.09:1—is particularly preferred.

As mentioned above, it can be provided according to the invention that the minimum widths of the cross-sectional constriction of the short circuit narrow section and those of the overload narrow section are at least substantially corresponding and/or designed to be the same.

It is most preferably provided that the cross-sectional constriction of the overload narrow section and/or the short circuit narrow section is designed homogeneously, in particular over the narrow section length. Preferably, the cross-sectional constriction is formed and/or produced by a punched-out section comprising a straight and/or curved edge.

In a further preferred embodiment, it is provided that in each case the cross-sectional constrictions of the overload narrow sections and/or the short circuit narrow sections are designed at least substantially identically.

Preferably, the second layer and/or the second section is at least substantially directly adjacent to the respective overload narrow section, in particular wherein the respective second layer is provided directly adjacent to each overload narrow section. In particular, according to the invention, a direct adjacency is also understood to mean that a small distance is provided between the second section and/or the second layer and the overload narrow section, which distance is especially smaller than or equal to the length of the respective overload narrow section. Such an arrangement especially enables a very low minimum breaking current to be achieved.

Furthermore, in a further preferred embodiment of the invention, it is provided that the second layer is firmly connected, preferably substance-bonded, to the outer shell surface of the melting wire. Finally, the second layer may be glued to the outer shell surface of the melting wire, in particular wherein the second layer has been dripped onto the outer shell surface of the melting wire. In particular, the second layer adheres to the outer shell surface of the melting wire.

In a further particularly preferred embodiment, it is provided that the second layer comprises and/or consists of a plastic and/or poly(organo)siloxane (also known as silicone) as the material, preferably as the arc extinguishing agent. Furthermore, the second layer can be designed to be electrically insulating.

Especially the combination of the solder of the first layer to the silicone and/or the material of the second layer can reduce the minimum breaking current and/or the smallest breaking current. According to the invention, by using the second layer comprising the silicone on the melting wire, a significant increase in the rated voltage of the DC fuse in the event of a short-circuit—assuming a predetermined product of the DC current and the DC voltage protected by the DC fuse—can be achieved.

By using the solder in the first coating, it is also possible to reduce the melting temperature of the melting conductor to values where especially the silicone is present at least essentially undamaged in its "pure form". If the first layer did not comprise any solder, a melting conductor temperature of the order of magnitude of the melting temperature of the material of the melting wire—for example, in the case of pure silver: 961° C.—would have to be reached even under overload. In this case, there would be a risk that the material of the second layer—namely the silicone—could no longer serve as an extinguishing arc agent and/or as an extinguishing medium.

The solder of the first layer can comprise metal, especially a metal alloy, as the material and/or consist of it Especially the metal alloy comprises cadmium, lead, tin, zinc, silver and/or copper. Most preferably, a metal alloy comprising tin and/or silver is provided. The first layer can further preferably serve to weaken the physical-chemical processes in the event of an overload, so as to enable a shutdown in particular—this is also known as the M-effect.

When selecting the first layer, it is especially important to consider legal guidelines—such as the EU's RoHS Directive—that restrict the use of hazardous substances in electronic devices; this especially applies to materials such as cadmium and/or lead.

In the case of overload currents, the greatest heat generation ultimately occurs in the area of the second section, especially in the area of the tin coating, which comprises the material of the solder, especially the tin or the tin-silver alloy. When the melting temperature is exceeded, the tin and/or silver becomes liquid and forms an alloy with the material of the melting wire. Compared to the material and/or material of the melting wire, this alloy has a lower and electrical and thermal conductivity and especially a lower melting point. As a result of the further increase in heat generation, the melting conductor and/or the melting wire becomes molten at the corresponding point below the actual melting point and separates the current path. This phenomenon was discovered by Metcalf in 1939, which is why it is also known and referred to as the M-effect. By applying the first layer to the melting wire, a fuse can utilize the previously described M-effect to trip the fuse.

Most preferably, a plurality of short circuit narrow sections is provided between two immediately successive overload narrow sections. Especially between two overload narrow sections in direct succession between 2 to 15, preferably between 3 to 6, short circuit narrow sections are provided.

Alternatively or additionally, it can be provided that the first section comprising the first layer is arranged—at least once in the melting conductor—between two directly successive short circuit narrow sections, preferably centrally between directly successive short circuit narrow sections and/or centrally between two directly successive overload sections, on the outer shell surface of the melting wire.

In further embodiments, the first layer may be arranged independently of the short circuit narrow sections and/or the overload narrow sections on the outer shell surface of the melting wire.

The plurality of short circuit narrow sections ensures safe disconnection of the current, especially the direct current, when the melting conductor is used in the fuse.

Preferably, the second sections comprising and/or forming the second layer are arranged on the outer shell surface of the melting wire in such a way that the two overload narrow sections and preferably the short circuit narrow section and/or the short circuit narrow sections arranged between the overload narrow sections are provided between two directly successive second sections and/or second layers. Consequently, an arrangement in the form of second layer and/or second section—overload narrow section—optionally at least one short circuit narrow section—overload narrow section—second layer and/or second section is particularly preferably obtained.

In a further, even more preferably embodiment, the overload narrow section is formed by recesses comprising an at least substantially rectangular edge.

Alternatively or additionally, the short circuit narrow section can also be formed by a recess comprising an at least substantially rectangular edge.

Especially the cross-sectional constriction of the overload narrow section and/or the short circuit narrow section can be formed by punch-outs comprising an at least substantially rectangular edge. In particular, the corners of the rectangular contour of the recesses can be formed at least substantially in the shape of arc sections and/or rounded. The punching out of the recess can be carried out, for example, by means of angular punches.

Preferably, the short circuit narrow section and/or the cross-sectional constriction of the short circuit narrow section is formed by recesses comprising an edge which is at least substantially in the shape of an arc section.

Alternatively or additionally, the cross-sectional constriction of the overload narrow section may also comprise the aforementioned circular arc-segment-shaped form.

The circular arc section-shaped recess can also be obtainable by punching, preferably by means of round punches. Especially, the short circuit narrow section and/or the overload narrow section is designed as an at least substantially round short circuit narrow section and/or the overload narrow section.

Preferably, at least two recesses are provided per cross-sectional constriction of the overload narrow section and the short circuit narrow section. The recesses can be arranged opposite one another, in particular wherein the two recesses per cross-sectional constriction of the overload narrow section and the short circuit narrow section are designed to be at least substantially identical and in particular are designed to be mirror-inverted relative to one another, wherein the recess can be mirrored along the central axis of the melting wire.

Finally, the overload narrow sections designed as cross-sectional constrictions and/or the short circuit constrictions designed as cross-sectional constrictions can be designed at least substantially identically.

Since the respective cross-sectional constrictions of the overload narrow section and/or the short circuit narrow section comprise an at least essentially identical heat exchange, it is possible that in the overload case or in the short-circuit case the melting conductor melts at different points of the melting wire, especially as a function of the overcurrent. The overcurrent flows through the melting wire and causes it to heat up.

For example, a circular arc section-shaped recess of the short circuit narrow section can dissipate the heat better than an overload section comprising an at least substantially rectangular recess, with at least substantially the same cross-sectional width and/or the same cross-sectional length, since especially the short circuit narrow section contains "more material". However, at a very high overload current, especially the minimum width of the cross-sectional constriction is an extremely relevant parameter, especially more relevant than the shape of the cross-sectional constriction, since the cross-sectional constriction initially melts in the center and not homogeneously.

It can be assumed that if excess current is available, some cross-sectional constrictions will melt faster than others. By combining different designs of the cross-sectional constrictions of the overload narrow section and the short circuit narrow sections, it is possible to obtain a reaction curve of the fuse comprising the melting conductor according to the invention, which especially considers the reaction curve and/or the response behavior of the individual cross-sectional constrictions and represents a superposition of just those individual reaction curves.

At very high overcurrents—i.e. in the event of a short circuit—those cross-sectional constrictions with the smallest minimum width, especially the short circuit narrow sections, melt first. In the case of a lower overcurrent and a somewhat "longer" shutdown time, the shape, especially the length and the particular geometry, of the cross-sectional constrictions is "taken into account" more. It is thereby provided that the cross-sectional constrictions of the overload narrow sections are melted in time before the short circuit narrow sections in the event of an overload due to the at least substantially rectangular shape of the recesses. Accordingly, the melting conductor can preferably enable disconnection of the direct current protected by the fuse as a function of the respective fuse behavior.

In a further particularly preferred embodiment, it is provided that the short circuit narrow sections arranged between the directly successive overload narrow sections are at least substantially regularly spaced. Consequently, the distance between two directly successive short circuit narrow sections in the area between two directly neighboring overload narrow sections can be designed to be at least substantially equal. This enables safe disconnection of the short-circuit current via the melting conductor.

Alternatively or additionally, it can be provided that the distance between two directly neighboring short circuit narrow sections and/or the distance between a short circuit narrow section to the directly neighboring overload narrow section is designed to be at least substantially equal. An equal spacing of directly neighboring and/or directly successive short circuit narrow sections enables a regular spacing of the short circuit narrow sections from each other. The equally designed distance between a short circuit narrow section and the immediately neighboring overload narrow section can in any case also be at least substantially equally designed if only one short circuit narrow section is arranged between two immediately successive overload narrow sections. In this case, the short circuit narrow section would then be arranged at least substantially centrally between the overload sections.

Preferably, the distance between a cross-sectional constriction of the short circuit narrow section and/or the overload narrow section to the immediately adjacent cross-sectional constriction of the short circuit narrow section and/or the overload narrow section is designed to be at least substantially equal. Particularly preferably, the cross-sectional constrictions of the overload narrow section and the short circuit narrow section of the melting conductor are at least substantially regularly spaced. This enables simplified manufacturing of the cross-sectional constrictions by punching out the melting wire, wherein at the same time the behavior in the overload case and in the short-circuit case is ensured by switching off the current, especially the direct current, by melting the melting conductor.

It is especially preferably provided that the distance between immediately adjacent cross-sectional constrictions of the overload narrow section and/or the short circuit narrow section is between 1 to 50 mm, preferably between 5 to 30 mm, even more preferably between 10 to 20 mm and especially at least substantially between 16 to 18 mm. The aforementioned distance can especially be the distance between immediately neighboring short circuit narrow sections and/or the distance between an overload narrow section and the immediately neighboring short circuit narrow section.

Alternatively or additionally, it may be provided that the distance between immediately neighboring overload narrow sections is between 20 to 150 mm, preferably between 40 to 100 mm, even more preferably between 50 to 80 mm, in particular at least substantially between 60 to 70 mm.

Furthermore, the length of the cross-sectional constriction of the overload narrow section can be designed to be greater than the length of the cross-sectional constriction of the short-circuit narrow section. Even more preferably, the length of the cross-sectional constriction of the overload narrow section to the length of the cross-sectional constriction of the short circuit narrow section comprises a ratio between 1:0.3 to 1:0.9, preferably between 1:0.5 to 1:0.85, more preferably between 1:0.7 to 1:0.8 and especially at least substantially 1:0.75. The increased length of the overload narrow section ensures that the melting wire can be switched off in the event of an overload due to a change in temperature. The increased length, in particular in combination with the minimum width of the overload narrow section as well as the shape of the overload narrow section, enables the overload case to be protected by melting of the melting conductor even if no short-circuit occurs.

Especially the extended length of the web allows a faster response of the melting conductor in case of an overload.

More preferably, the first and/or the second layer is designed as a coating. A coating by means of the material of the first and/or the second layer enables a target- and purpose-oriented coating in the first and/or in the second section and thus especially ensures a possible coating with the first and/or second layer which completely surrounds the melting wire in certain areas or circumferentially. The first and/or second layer can be applied in a targeted manner in their respective sections, in particular wherein a coating application enables inline production.

Furthermore, preferably the length of the cross-sectional constriction of the overload narrow section can be between 1 to 5 mm, preferably between 1.5 to 3 mm, in particular wherein the length of the overload narrow section is at least substantially 2 mm.

In a further particularly preferred embodiment of the invention, the melting wire comprises an at least substantially rectangular cross-sectional shape. Alternatively or additionally, it may be provided that the melting wire is designed as a flat strip, in particular wherein the strip width and/or the height of the flat strip may be 0.04±0.02 mm. The melting wire designed as a flat strip can comprise the recesses of the overload narrow section and/or the short circuit narrow section—produced by punching, especially by means of punches.

In an alternative embodiment, it may be provided that the melting wire comprises an at least substantially circular outer cross-section. Especially, in this embodiment, the first and/or the second layer may comprise an at least substantially circular outer cross-section.

Preferably, the material of the melting wire is a metal. The material of the melting wire may also be referred to as the melting wire material. Preferably, the melting wire material comprises silver and/or a silver alloy.

Alternatively or additionally, the melting wire may comprise as material an electrically conductive material, especially copper and/or a copper alloy, and/or consist thereof.

More preferably, at least substantially pure silver is used. The degree of purity of the silver can be designed to be greater than 99%. In particular, the purity of silver is designed to be greater than 99.9%, more preferably at least substantially equal to 99.99%. A purity of silver of 99.99% provides the proportion of silver (Ag) in the material. Accordingly, preferably the silver is designed as fine silver.

Alternatively or additionally, it may be provided that the melting wire comprises and/or consists of copper and/or a copper alloy.

The melting temperature of the material of the melting conductor can be greater than 900° C., in particular between 950 to 970° C., in particular wherein the melting temperature of the melting wire can be 961° C. The density of the material of the melting wire may be at least substantially 10.5 g/cm$^3$.

The use of pure silver as opposed to copper, which can be used as the material for the melting wire in low voltage fuses, lends itself to the use of copper because of the permanently higher temperatures that occur during operation of a high voltage fuse. The use of copper in a high-voltage fuse could lead to oxidation of the surface and especially have fatal consequences during disconnection, especially of the direct current.

Preferably, the melting conductor for use in a high voltage high power DC fuse comprises a length greater than 500 mm, preferably a length between 500 mm to 3000 mm, even more preferably between 1000 mm to 2500 mm, especially at least substantially between 1500 mm to 2000 mm. The melting conductor can be designed in such a way that it can be wound onto a winding body in the form of a helix, so that the length of the fuse can be less than the length of the melting conductor.

It is particularly preferred that an alternating sequence of directly successive overload narrow sections is provided in the melting conductor. Preferably, the at least one short circuit narrow section and/or the short circuit narrow sections are arranged between two directly successive overload sections. Especially it is provided that the overload points are at least substantially regularly spaced—that is comprise an at least substantially constant distance to each other. The aforementioned design of the melting conductor with the alternating sequence of overload narrow sections can lead to a simply predeterminable behavior of the fuse in the event of an overload and in the event of a short circuit. The producing of the melting conductors comprising the cross-sectional narrow sections is also simplified by the regular, sequence-like arrangement of the cross-sectional narrow sections of the overload narrow section and the short-circuit narrow sections.

In a sequence-like arrangement of the overload narrow sections, the first section is arranged especially at least once, preferably once, between a pair of overload narrow sections.

In a sequence-like arrangement of the overload narrow sections in the melting conductor, it is preferably provided that the sequence of the overload narrow sections with short circuit narrow sections arranged therebetween is at least substantially regularly and/or identically designed.

Preferably, the ratio of the maximum width of the melting wire to the minimum width of the cross-sectional constriction of the overload narrow section and/or the cross-sectional constriction of the short circuit narrow section is between 1:0.6 to 1:0.2, preferably between 1:0.5 to 1:0.3, further preferably between 1:0.4 to 1:0.35. The melting wire may especially comprise a maximum width of greater than 0.6 mm, preferably between 1 mm to 2 mm, further preferably at least substantially 1.6 mm.

Furthermore, the present invention relates to a fuse for fusing a DC transmission, especially a high voltage high power DC fuse, having an outer fuse box. At least one melting conductor wound around a, especially electrically insulating, winding body is arranged in the fuse box according to at least one of the embodiments described earlier.

It is understood that a plurality of melting conductors may also be arranged around the winding body. The melting conductor preferably comprises a plurality of overload narrow sections, which may be regularly spaced apart.

It is understood that the above-mentioned preferred embodiments of the melting conductor according to the invention and/or the advantages described in connection with the melting conductors according to the invention are applicable to the fuse according to the invention in the same way. To avoid unnecessary repetition, reference is made to the preceding explanations with regard to explanations in this respect.

In a preferred embodiment of the invention, it is provided that the fuse box is at least partially open on two end faces, wherein at least one contact cap designed for electrical contacting is arranged on each end face of the fuse box.

By preferably winding the at least one melting conductor, the length of the fuse can be held as short as possible, as previously explained, in particular wherein the length of the fuse can be between 300 mm to 1000 mm, preferably between 500 mm to 600 mm.

To transmit the DC voltage, the length of the melting conductor required for this purpose is used, which does not correspond to the entire length of the fuse because the melting conductor is ultimately wound around the winding body. Ultimately, the length of the melting conductor is greater to much greater than the length of the fuse.

Preferably, the winding body is designed in such a way that the melting conductor, especially at least substantially at each turn, lies punctual—possibly at several support points. Accordingly, the winding body may comprise protrusions and depressions resulting between the protrusions. Most preferably, the winding body is designed to be at least substantially star-shaped.

Preferably, the DC voltage of the transmitting DC current and/or the rated voltage and/or the rated voltage range of the fuse is greater than 1 kV, preferably greater than 1.5 kV, further preferably greater than 5 kV. Alternatively or additionally, it is provided that the DC voltage and/or the rated voltage of the fuse is less than 150 kV, preferably less than 100 kV, even more preferably less than 75 kV, and/or is between 1 kV to 100 kV, preferably between 1.5 kV to 50 kV, even more preferably between 3 kV to 30 kV. The rated voltage and/or the rated voltage range of the fuse is to be understood especially as the voltage and/or the voltage range at which the fuse is used and/or is tested for the fuse. Basically, a distinction must be made between an upper rated voltage and a lower rated voltage, wherein the lower rated voltage provides the voltage at which the fuse still switches, while the upper rated voltage represents the upper limit for the DC voltage to be transmitted. Consequently, the rated voltage and/or the rated voltage range provides the permissible voltage range of the fuse. Especially the rated voltage range corresponds to the DC voltage range that can be protected by the fuse.

In a further particularly preferred embodiment, it is provided that the smallest breaking current of the fuse is greater than 3 A, preferably greater than 5 A, even more preferably greater than 10 A. Alternatively or additionally, it is provided that the smallest breaking current of the fuse is less than 1 kA, preferably less than 500 A, even more preferably less than 300 A, and/or is between 3 A to 700 A, preferably between 5 A to 500 A, even more preferably between 15 A to 300 A.

Alternatively or additionally, it can be provided according to the invention that the smallest breaking current of the fuse is greater than or equal to the rated current rating, in particular greater than or equal to twice the rated current rating, preferably greater than twice and/or less than 15 times the rated current rating, even more preferably greater than three times and/or less than eight times the rated current rating. The above-mentioned relative rating of the smallest breaking current is advantageous in that especially the smallest and/or the minimum breaking current is directly dependent on the rated current of the respective fuse link.

Preferably, the rated breaking capacity is designed to be greater than 1 kA, preferably greater than 10 kA, further preferably greater than 20 kA, and/or is between 1 kA to 100 kA, preferably between 10 kA to 80 kA, further preferably between 10 kA to 50 kA. The rated breaking capacity of the fuse is especially the rated value of the highest breaking current. The maximum breaking current is the maximum DC current that the fuse can still switch. Consequently, the rated breaking capacity of the fuse should be greater than the maximum short-circuit current at the point of use of the fuse.

Furthermore, according to a further embodiment of the invention, the direct current which is transmitted and protected by the fuse and/or the rated current range is greater than 5 A, preferably greater than 10 A, even more preferably greater than 15 A. Alternatively or additionally, it is provided that the DC current is between 3 A to 100 kA, preferably between 10 A to 75 kA, even more preferably between 15 A to 50 kA. Especially, the range of the current of the direct current to be transmitted is predetermined as a function of the rated breaking capacity and the smallest breaking current of the fuse.

Ultimately, it is understood that different fuses can also be provided as a function of the respective DC current transmission, which can be designed for the respective application. Thus, the design of the fuse can be selected especially as a function of the DC current and/or the DC voltage to be transmitted.

Furthermore, preferably the product (mathematical multiplication) of the direct current and the direct voltage protected by the fuse is greater than 5 kW, preferably greater than 50 kW, further preferably greater than 700 kW. Alternatively or additionally, it is provided that the product of the DC current protected by the fuse and the DC voltage is less than 3000 MW, preferably less than 2000 MW, even more preferably less than 1000 MW, and/or is between 5 kW and 3000 MW, preferably between 500 kW and 2000 MW, even more preferably between 700 kW and 1000 MW.

Especially, the product of the DC current and the DC voltage protected by the fuse can correspond to the power of the consumer and/or the consumers (total power) protected by the fuse. Finally, the aforementioned product corresponds especially to the power that can be secured by the fuse.

According to another preferred embodiment, it is provided that the fuse comprises at least two melting conductors, preferably between 2 to 10 melting conductors, even more preferably between 3 to 5 melting conductors, arranged in the fuse box. Especially the melting conductors are connected electrically contacting with each other and/or with the contact cap.

More preferably, the DC application is a medium voltage DC distribution and/or a high voltage DC distribution. Consequently, the fuse can be used in networks arranged in the medium-voltage DC range and/or in the high-voltage DC range. Medium-voltage DC range is to be understood especially as a DC voltage of greater than 1 kV, preferably greater than 2 kV, even more preferably greater than 3 kV, and/or less than 50 kV, preferably less than 40 kV, even more preferably less than 30 kV. A high-voltage DC range is to be understood especially as a voltage range of more than 60 kV, preferably more than 100 kV, even more preferably more than 200 kV.

Preferably, the fuse can be arranged in a medium-voltage DC distribution network, especially in a medium-voltage DC system. At least one DC device, in particular a MVDC device (Medium Voltage Direct Current Device), can be arranged in the medium-voltage DC distribution network. The direct current may be provided by a power conversion device to the medium voltage direct current transmission network.

Alternatively or additionally, it can be provided according to the invention that the direct current originates from a photovoltaic installation and/or a photovoltaic surface installation, especially a solar park, and/or a wind power installation and/or a wind park, especially an offshore wind park. Alternatively and/or additionally, it is possible according to the invention that the electricity originating especially from at least one of the aforementioned energy conversion plants is used to supply a medium-voltage and/or high-voltage grid which is closed and/or encapsulated in itself. Especially direct currents originating from renewable energies can be used for the supply of consumers. Especially the current generated in the aforementioned installations is direct current, which preferably does not have to be converted into alternating current before being fed into the grid.

Preferably, the fuse box of the fuse is designed to be hollow cylindrical and/or tubular. The top and underside of the fuse box is especially designed to be open at least in certain areas.

On the end face, the fuse box can be enclosed, preferably tightly, by the contact cap. Alternatively or additionally, the contact cap can be placed on the end face of the fuse box. In particular, the contact cap serves for electrical connection, wherein the melting conductor is electrically connected to the contact cap.

In particular, the contact cap may comprise a diameter between 30 to 100 mm, preferably between 50 to 90 mm. Preferably, it is provided that the contact cap comprises a standardized, preferably DIN-standardized, diameter, especially the contact cap can comprise a diameter of 53 mm+/−5%, 67 mm+/−5% or 85 mm+/−5%.

Especially at least one contact cap covers at least a partial area of the fuse box, especially a partial area of the lateral surface in the front area. The partial covering in the front area of the fuse box ensures a fixed arrangement of the contact cap on the fuse box.

According to an even more preferably embodiment, a further top cap is arranged in front of the contact cap, which is placed on the contact cap and/or at least partially covers the contact cap. Thereby the inner contact cap can be designed as an auxiliary cap. The two-part design of the contact cap ensures reliable electrical contact, which is especially advantageous in long-term use. Furthermore, this embodiment enables a particularly firm connection and/or arrangement of the contact cap on the fuse box.

In a further embodiment according to the invention, it is provided that the fuse box comprises and/or consists of a ceramic material. Ceramic material is to be understood especially as a multitude of inorganic, non-metallic materials, which can preferably be subdivided into the types earthenware, crockery, stoneware, porcelain and/or special masses. Preferred ceramic special masses are electroceramics and/or high-temperature special masses.

Alternatively or additionally, it may be provided that the fuse box comprises a material of plastic, preferably melamine, and/or of a glass-fiber-reinforced plastic and/or consists thereof.

An extinguishing agent, especially an extinguishing sand filling, preferably quartz sand, and/or air, can be provided in the fuse box. The extinguishing agent serves in case of switching of the fuse, especially in case of short-circuit, to extinguish an arc and/or to cool down the possibly melted melting conductor and/or the melting conductor residues.

The melting conductor may be at least partially embedded in and/or surrounded by the extinguishing agent, so that the extinguishing agent can act on the melting conductor, especially when the melting conductor melts.

In an even more preferably embodiment, the fuse box is at least substantially hermetically encapsulated. By hermetic encapsulation and/or sealing is meant an airtight and/or gas-tight sealing of the system, in particular protected from water and/or liquids.

According to a further embodiment of the invention, it is provided that the melting conductors are electrically connected in parallel and/or are wound at least in essence helically around the winding body. The parallel electrical connection of the melting conductors is advantageous in the case of a plurality of melting conductors in the event of short-circuiting and/or tripping of the fuse, since the tripping of only one melting conductor is sufficient for switching. The helical winding of the melting conductor allows the length of the melting conductor required for the fuse to be enclosed in the fuse box.

The winding body can be designed as a single piece or from several elements. Especially the winding body comprises hard porcelain as material and/or consists thereof. Moreover, the winding body can be designed in such a way that a plurality of chambers are formed, in particular wherein a cross-sectional constriction can be provided in one chamber. Due to the cross-sectional constriction, a plurality of partial arcs can be formed at each melting conductor when the fuse responds, so that the amount of heat converted can be distributed uniformly over the entire length of the fuse tube during the disconnection process.

In a further, even more preferably embodiment, the fuse comprises a release device. The release device can be designed and/or arranged in a contact cap for switching a device arranged on the fuse, especially a transformer switch and/or a load switch, preferably with free release. Especially the release device comprises a strike pin release mechanism. When the strike pin release mechanism is triggered, it is provided that the strike pin, which is in particular at least essentially cylindrical, penetrates the contact cap, preferably a densely soldered copper foil and/or a breakthrough layer, in particular a paper sticker layer.

The strike pin of the strike pin release mechanism of the release device can be triggered by an auxiliary melting conductor. Especially, the strike pin is triggered in the event of a short circuit.

Preferably, a preloaded spring is associated to the strike pin, in particular wherein the spring can be designed such that when the auxiliary fusible link is triggered, especially in case of a short-circuit, the strike pin emerges from the end face of one of the contact caps. Especially the strike pin can act on a load switch, which can then switch off the faulty current at all poles.

More preferably, the auxiliary melting conductor is provided to run along the entire length of the fuse box and/or axially through the center of the winding body. Accordingly, the auxiliary melting conductor does not have to be wound around the winding body.

Especially, the auxiliary melting conductor can be connected in parallel with the melting conductor and/or the melting conductors, especially so that when a melting conductor is melted, a current flows through the auxiliary melting conductor, which leads to activation of the strike pin.

Preferably, a release device can be associated to the fuse box, which is designed in such a way that after the strike pin has been released, it can no longer be pressed and/or displaceable into the fuse box. If the strike pin is released, the safety device prevents the strike pin from resuming the position it occupied before being released. Especially as long as the direct current is to remain cut and/or switched off, the load switch to be arranged on the strike pin can be permanently actuated by the strike pin in the event of a short-circuit.

At least one indicating device can be associated to the fuse. Especially the indicating device is designed for optical indication of a state. The indicating device can also be arranged in the contact cap. The indicator can also be used as an alternative to the strike pin release mechanism and indicate the release of the fuse by means of a visual and/or audible signal. Ultimately, the indicator device serves to inform the operating personnel that the high voltage high power fuse has been tripped.

According to a further embodiment, it is provided that the contact caps have a galvanic coating and/or a silver coating. The contact caps may comprise and/or consist of electrolytic copper and/or aluminum. The aforementioned materials enable good electrical contacting.

Furthermore, the invention relates especially to a system with a consumer which can be supplied by direct current and with at least one fuse which comprises the melting conductor according to the invention and is designed according to at least one of the embodiments described earlier. The direct current is transmitted to the consumer, wherein the direct current can be protected by the fuse. A consumer is thereby preferably provided as the user.

To avoid unnecessary repetition, reference is made to the previous explanations with regard to the melting conductor according to the invention and the fuse according to the invention, which also apply in the same way to the system according to the invention. Ultimately, it is understood that the advantages and preferred embodiments of the fuse according to the invention and/or the melting conductor according to the invention, which have already been set forth, are transferable to the system according to the invention.

According to a particularly preferred embodiment, it is provided that the consumer, which can especially also be formed from a plurality of consumers, comprises a (total) power of greater than 5 kW, preferably greater than 50 kW, even more preferably greater than 700 kW, and/or comprises a (total) power of less than 3000 MW, preferably less than 2000 MW, even more preferably less than 1000 MW. Furthermore, alternatively or additionally the power of the consumer can be between 50 kW and 3000 MW, preferably between 50 kW and 2000 MW, even more preferably between 700 kW and 1000 MW. Consequently, consumers with a high power can also be supplied by the DC distribution network which, according to the invention, is protected by at least one fuse.

Furthermore, it is understood that any intermediate intervals and individual values contained therein are included in the aforementioned intervals and range limits and are to be considered disclosed as essential to the invention, even if these intermediate intervals and individual values are not specifically provided.

Further features, advantages and possible applications of the present invention will be apparent from the following description of examples of embodiments based on the drawing and the drawing itself. Thereby all described and/or illustrated features form the subject of the present invention, either individually or in any combination, irrespective of their summary in the claims and their correlation.

Figure 2:
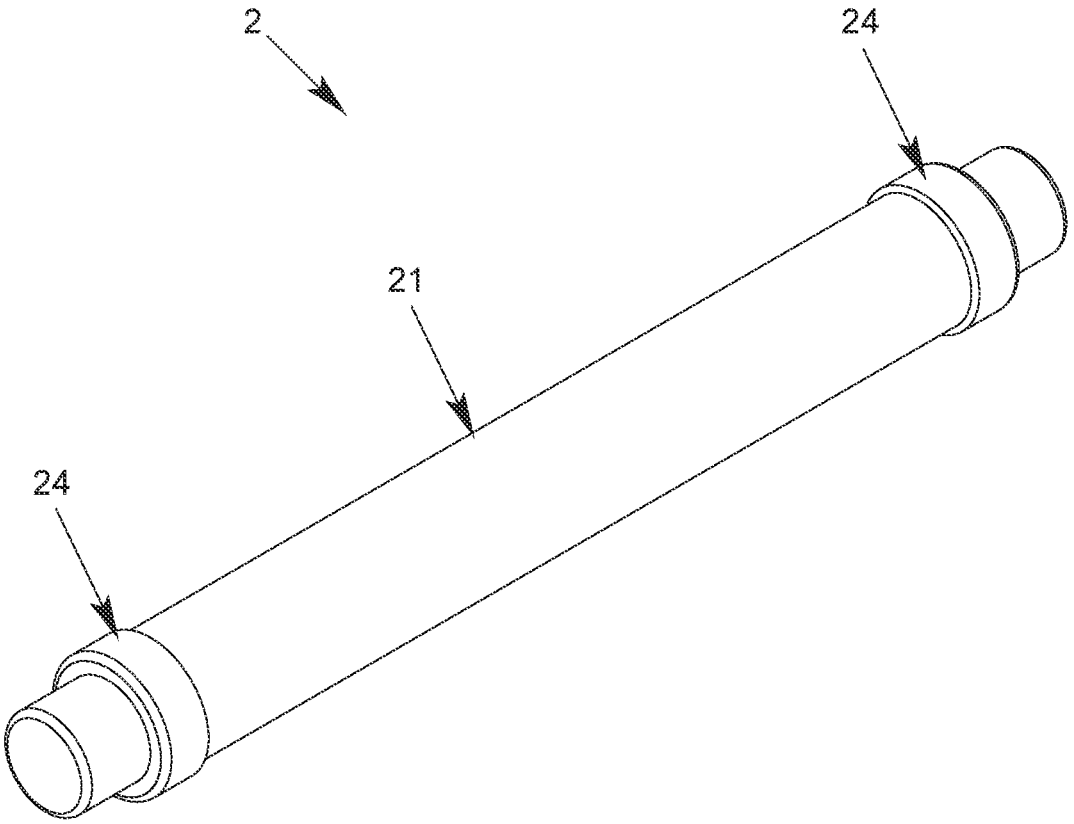
Figure 3:
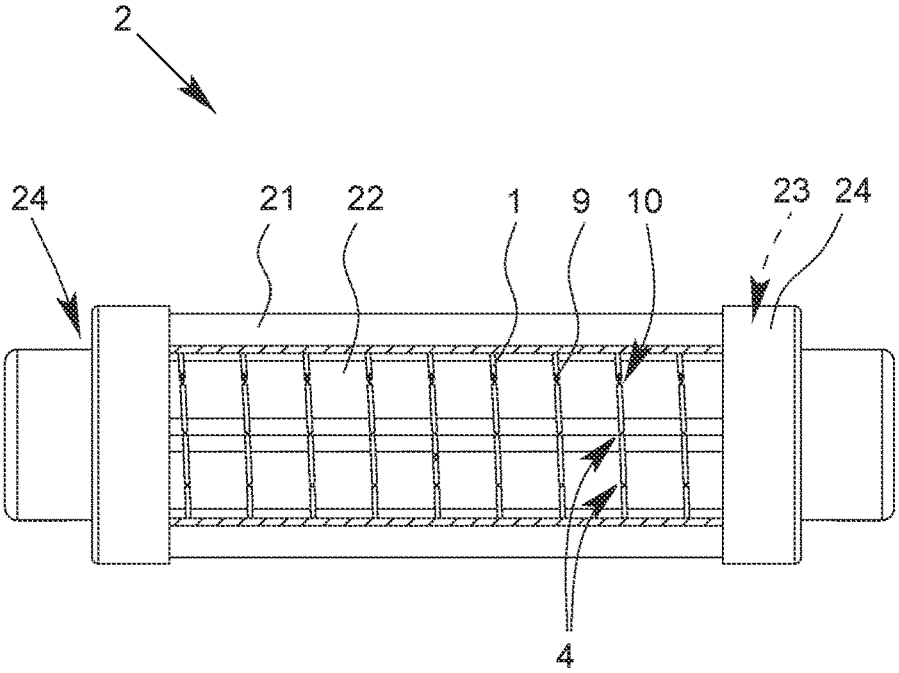
Figure 4:
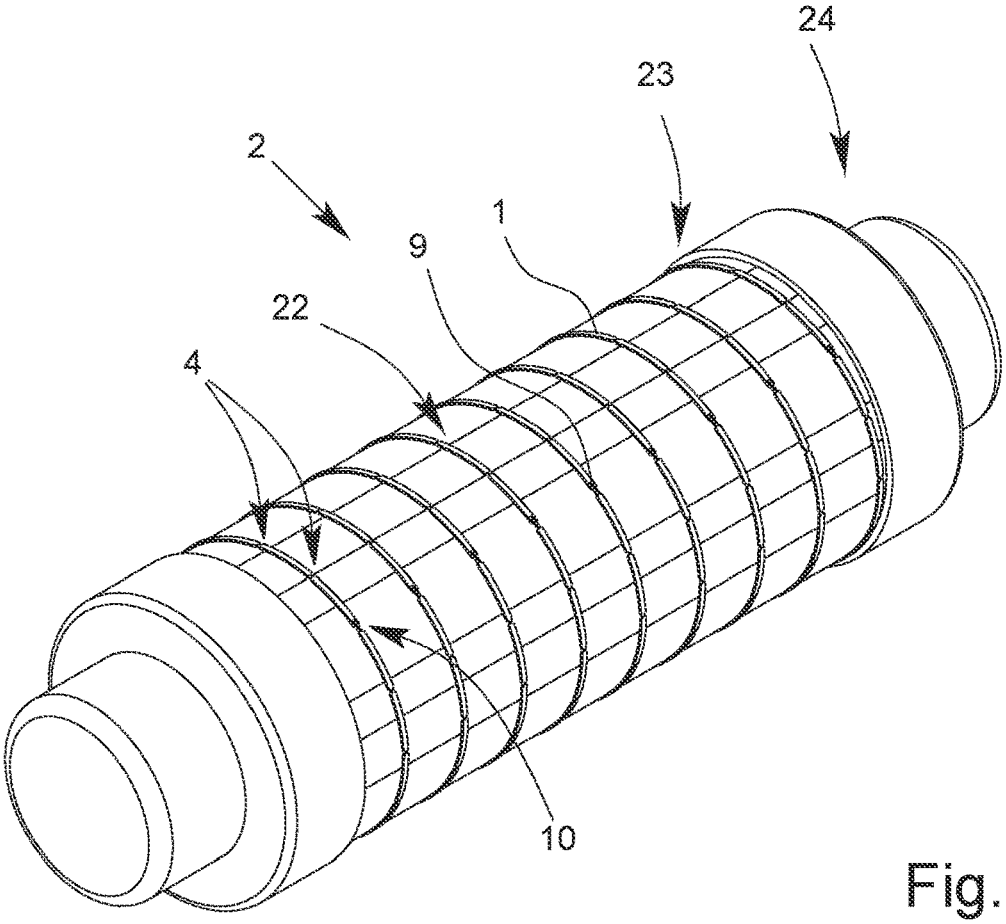
Figure 5:
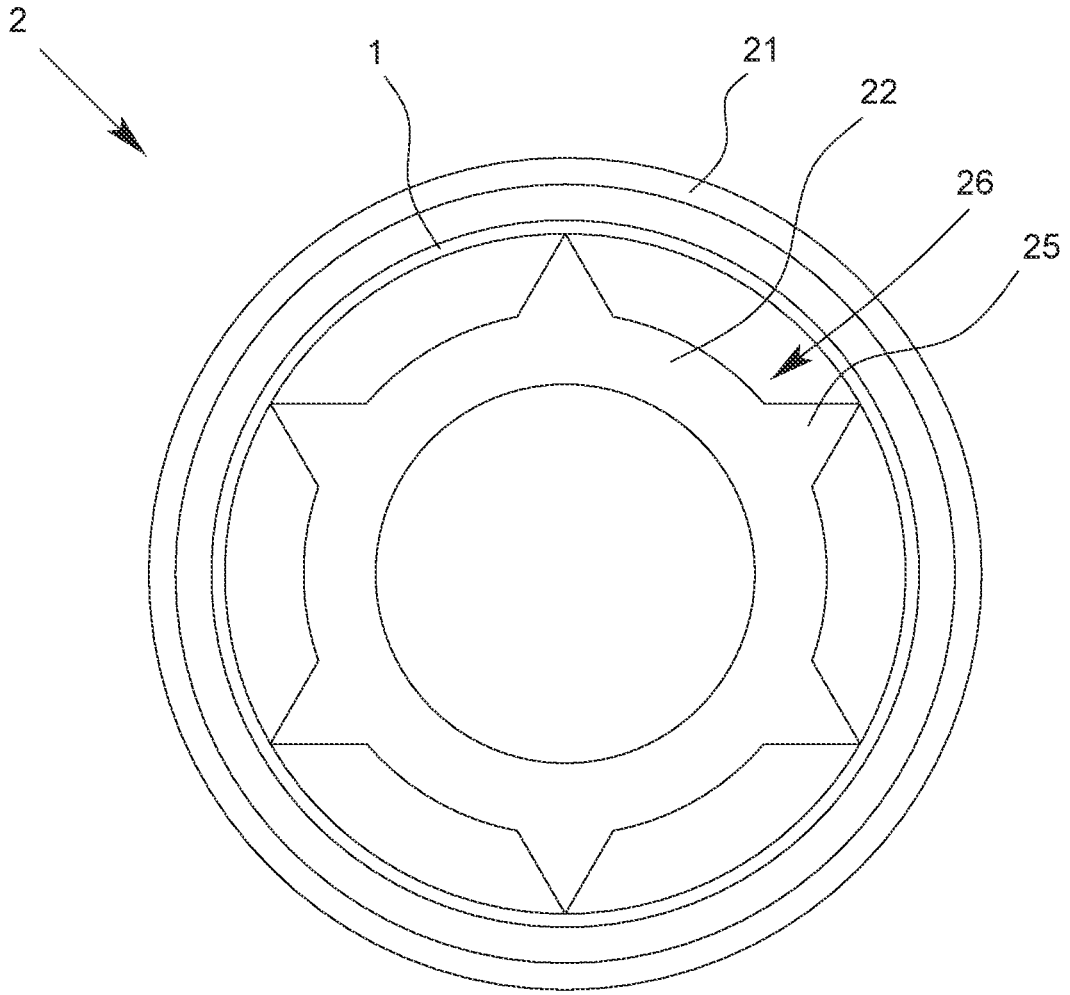
Figures 6A, 6B, 6C:
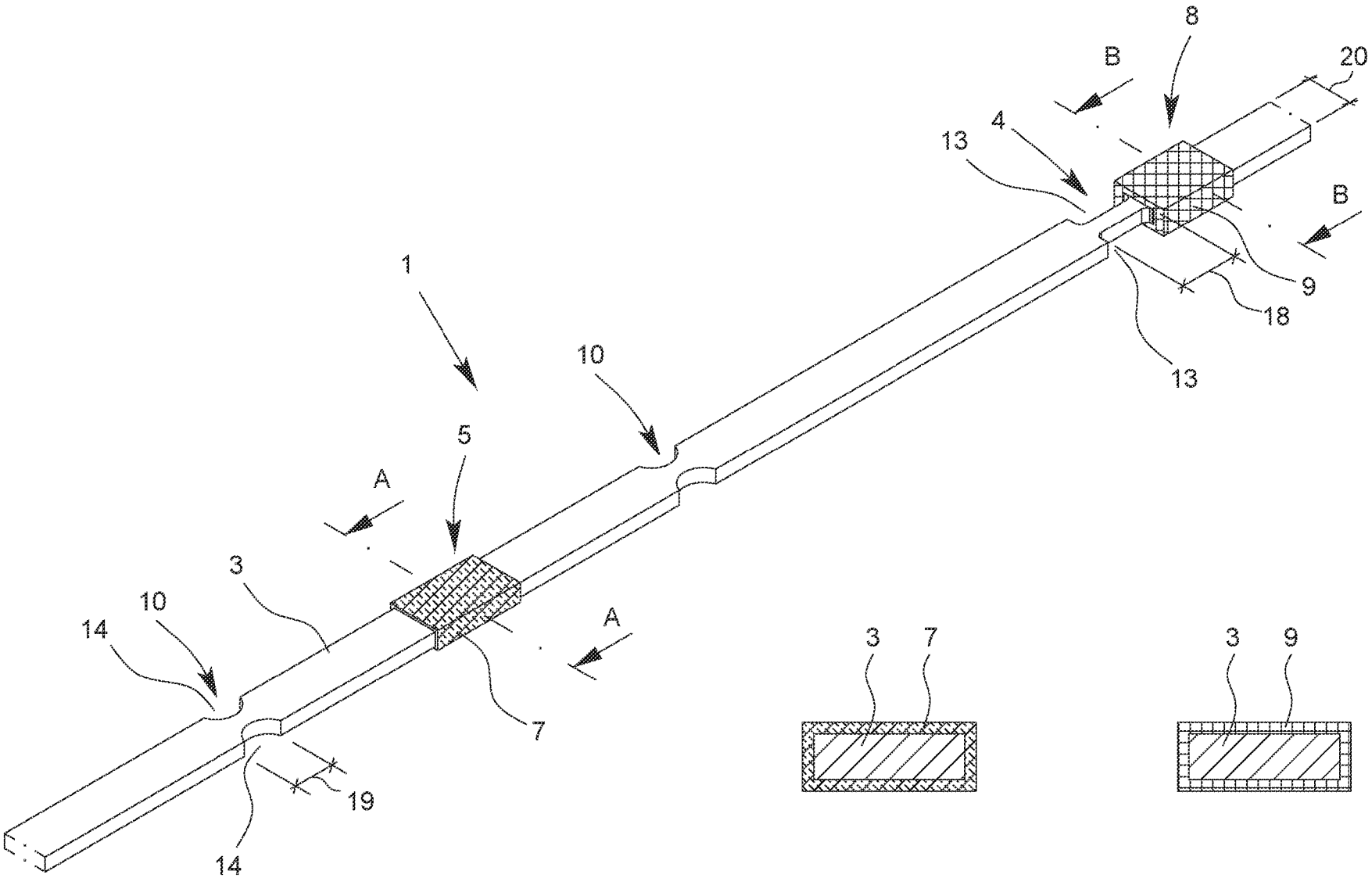
Figure 7:
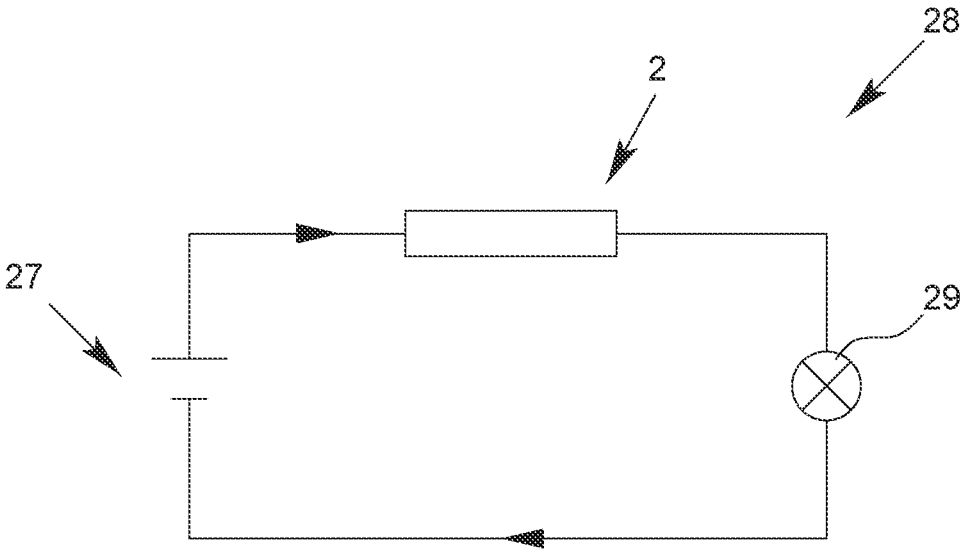
Figure 8:
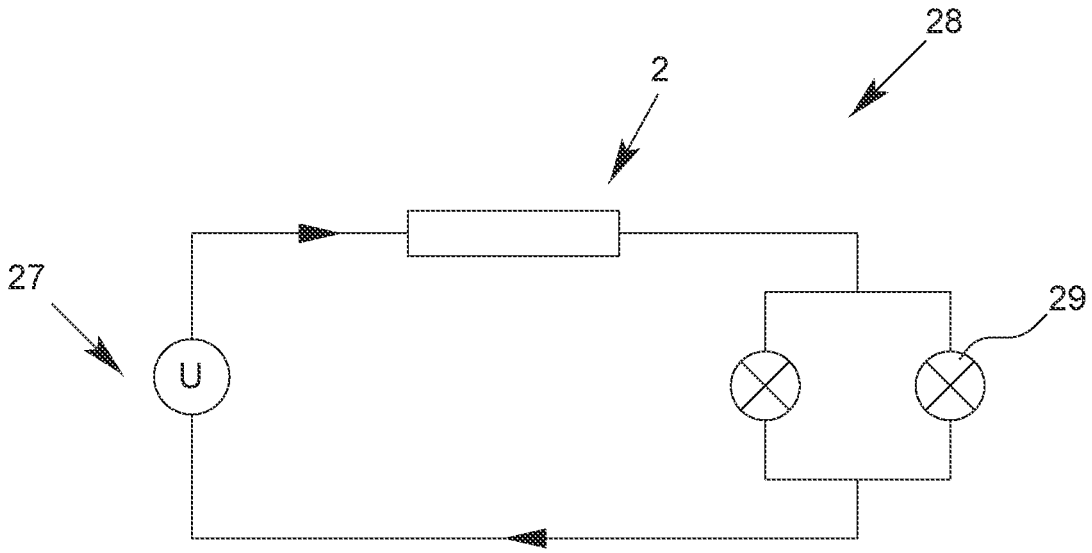

It shows:

FIG. 1 a schematic view of a melting conductor according to the invention,

FIG. 2 a schematic perspective illustration of a fuse according to the invention, FIG. 3 a schematic cross-sectional view of a further embodiment of a fuse according to the invention, FIG. 4 a schematic perspective illustration of a melting conductor according to the invention wound around a winding body, FIG. 5 a schematic cross-sectional view of a further embodiment of a fuse according to the invention, FIG. 6*a* a schematic perspective illustration of a further embodiment of a melting conductor according to the invention, FIG. 6*b* a schematic cross-sectional view along cut A-A of FIG. 6*a*, FIG. 6*c* a schematic cross-sectional view along cut B-B of FIG. 6*a*, FIG. 7 a schematic principle representation of a use of a fuse according to the invention for fuse protection of a direct current transmission, and FIG. 8 a schematic diagram of a further embodiment of the use of a fuse according to the invention for fuse protection of the DC transmission.

FIG. 1 shows a melting conductor 1. As can be seen in FIG. 3, the melting conductor 1 is intended for use for a DC fuse 2, especially a high voltage high power DC fuse 2 (HH-DC fuse). The fuse 2 may be provided for fuse protection of a DC application, as shown schematically in FIGS. 7 and 8.

FIG. 1 further shows that the melting conductor 1 comprises an electrically conductive melting wire 3. The melting wire 3 comprises at least two overload narrow sections 4 formed as cross-sectional constrictions. In a first section 5—at least once on the melting wire 3—a first layer 7 comprising and/or consisting of solder is provided, which circumferentially surrounds the outer shell surface 6 of the melting wire 3 at least in areas, preferably completely.

The first layer 7 and/or the first section 5 can be arranged at least once on the outer shell surface 6 of the melting wire 3, especially in the central area of the melting wire 3.

Furthermore, FIG. 1 shows that adjacent to each of the overload narrow sections 4, in each case in a second section 8, a second layer 9 is provided circumferentially surrounding the outer shell surface 6 of the melting wire 3 at least in some areas, preferably completely.

The overload narrow sections 4 are arranged in succession in the longitudinal direction L of the melting wire 3.

In the embodiment example shown in FIG. 1, it is provided that the first section 5 is provided between the two directly successive overload narrow sections 4. The first layer 7 need not thereby be arranged centrally between the two overload narrow sections 4, but may be so in further embodiments.

In addition, FIG. 1 shows that the melting wire 3 comprises at least one short circuit narrow section 10 in the form of a cross-sectional constriction between two directly successive overload narrow sections 4. In the illustrated embodiment example, the minimum width 11 and the shape of the cross-sectional constriction of the overload narrow section 4 differ from the minimum width 12 and the shape of the cross-sectional constriction of the short circuit narrow section 10. The minimum widths 11, 12 of the cross-sectional constrictions ultimately provide the smallest width in the region of a cross-sectional constriction. For example, the short circuit narrow section 10 comprises different widths in the area of the cross-sectional constriction.

According to the shape and the minimum width 11, 12 of the cross-sectional constriction, the response behavior of the melting conductor 1 in the case of tripping—for overload protection—can be adjusted accordingly.

In the embodiment example shown in FIG. 1, it is provided that the minimum width 11 of the cross-sectional constriction of the overload narrow section 4 is larger than the minimum width 12 of the cross-sectional constriction of the short circuit narrow section 10. Thereby, the ratio of the minimum width 11 of the cross-sectional constriction of the overload narrow section 4 to the minimum width 12 of the cross-sectional constriction of the short circuit narrow section 10 may be between 1.15:1 to 1.5:1. In further embodiments, the aforementioned ratio may be between 1.01:1 to 3:1.

It is not shown that the shape of the cross-sectional constriction and/or the minimum width 11 of the overload narrow section 4 is at least substantially the same and/or identical in construction to the shape of the cross-sectional constriction and/or the minimum width 11 of the short circuit narrow section 10.

FIG. 1 shows that the second layer 9 is immediately adjacent to the overload narrow section 4. In addition, FIG. 1 shows that the second layer 9 is firmly connected to and/or adheres to the outer shell surface 6 of the melting wire 3, preferably in a substance-bonded and/or adhesive bonding manner.

Not shown is that the second layer 9 comprises and/or consists of a plastic and/or poly(organo)siloxane as material, preferably as arc extinguishing agent. In further embodiments, the second layer 9 may at least substantially consist of silicone. The second layer 9 may alternatively or additionally be designed to be electrically insulating.

FIG. 5 shows that the second layer 9 is at least substantially directly adjacent to the cross-sectional constriction of the overload narrow section 4, but does not protrude and/or penetrate into the area of the cross-sectional constriction of the overload narrow section 4.

Further not shown is that the solder of the first layer 7 comprises and/or consists of a metal alloy as material. In further embodiments, the metal alloy may comprise and/or consist of cadmium, lead, tin, zinc, silver and/or copper. Further, a metal alloy comprising tin and/or silver may be provided. The first layer 7 may be designed to be electrically conductive.

In addition, FIG. 1 shows that a plurality of short circuit narrow sections 10 are provided between two directly successive overload narrow sections 4—as viewed in longitudinal direction L. In the illustrated embodiment, three short circuit narrow sections 10 are provided between two overload sections 4. In further embodiments, between two and 15 short circuit narrow sections 10 can be provided between two directly successive overload narrow sections 4.

Furthermore, FIG. 1 shows that the first layer 7 and/or the first section 5 comprising the first layer 7 is arranged between two directly successive short circuit narrow sections 10 on the outer shell surface 6 of the melting wire 3. The first section 5 may—but need not—be provided at least substantially centrally between two short-circuit narrow sections 10.

In addition, FIG. 1 shows that the second sections 8 comprising the second layer 9 are arranged on the outer shell surface 6 of the melting wire 3 in such a way that the two overload narrow sections 4 and, in the embodiment shown, the short circuit narrow sections 10 arranged between the overload narrow sections 4 are provided between two directly successive second sections 8 and/or second layers 9—running in longitudinal direction L. Ultimately, the second sections 8 "enclose" and/or "frame" the two directly successive overload narrow sections 4 and the short circuit narrow sections 10 arranged therebetween.

FIGS. 1 and 6*a* show that the overload narrow section 4 is formed by recesses 13 comprising an at least substantially rectangular edge. The recesses 13 can be created by punching, in particular by means of rectangular punches.

Furthermore, it is shown in FIG. 1 that the corner and/or the corner area of the recess 13 comprises a rounding. By means of the recesses 13 comprising at least substantially the rectangular edge, a cross-sectional constriction of the overload narrow section 4 comprising an at least substantially rectangular cross-sectional shape can be formed.

Based on the detailed representation of the short circuit narrow section 10 in FIG. 1, it is readily apparent that the short circuit narrow section 10 is formed by recesses 14 comprising an at least substantially circular arc section-shaped edge. The recesses 14 can be created by punching. Especially the cross-sectional constriction of the short-circuit narrow section 10 and/or the overload narrow section 4 is designed at least substantially mirror-symmetrical—especially with respect to the center axis of the melting wire 3.

FIG. 6*a* shows that the cross-sectional constriction of the short circuit narrow section 10 comprises an at least substantially circular arc section-shaped contour—in the plan view of the melting wire 3. The contour of the cross-sectional constriction of the overload narrow section 4 can be designed straight, in particular wherein rounded corners and/or roundings are provided in the corner regions of the cross-sectional constriction of the overload narrow section 4.

The short circuit narrow sections 10 shown in FIG. 1 are spaced at least substantially regularly between the overload sections 4—viewed in longitudinal direction L. Especially the short circuit narrow sections 10 comprise at least substantially the same distance 15 from each other. In further embodiments, the distance 15 can be between 5 and 30 mm, in particular between 10 and 20 mm.

FIG. 1 further shows that the distance 16 between a short-circuit narrow section 10 and the immediately neighboring overload narrow section 4 is designed to be at least substantially equal. The distance 16 always results between the cross-sectional constriction of the overload narrow section 4 to the next cross-sectional constriction, namely the cross-sectional constriction of the short circuit narrow section 10. This distance 16 is especially equal. In further embodiments, the distance 16 may correspond to the distance 15.

Furthermore, the distance 17 between a cross-sectional constriction of the short circuit narrow section 10 and/or overload narrow section 4 to the immediately adjacent cross-sectional constriction of the short circuit narrow section 10 and/or overload narrow section 4 can be designed to be at least substantially the same. The distance 17 can be designed both as a distance 15 and as a distance 16.

The distance 17 may also be designed to be at least substantially the same regardless of the short circuit narrow section 10, namely in embodiments in which no short circuit narrow section is provided, and/or regardless of the plurality of short circuit narrow sections 10, namely in embodiments in which only a single short circuit narrow section 10 is provided between two immediately neighboring overload narrow sections 4. The distance 17 ultimately provides the distance between two immediately neighboring cross-sectional constrictions—viewed in the longitudinal direction L of the melting wire 3—, wherein the cross-sectional constriction can be formed both by a short circuit narrow section 10 and by an overload narrow section 4. Finally, the cross-sectional constrictions on the melting wire 3 are in particular regularly spaced.

The distance between two immediately neighboring overload narrow sections 4 can be between 50 to 80 mm, especially between 60 to 70 mm.

In the embodiment example shown in FIG. 1, it is provided that the length 18 of the cross-sectional constriction of the overload narrow section 4 is greater than the length 19 of the cross-sectional constriction of the short circuit narrow section 10. Ultimately, the cross-sectional constriction of the overload narrow section 4 may be designed to be at least substantially elongated. The length 18 of the cross-sectional constriction of the overload narrow section 4 can be between 1 and 3 mm and especially 2 mm±0.5 mm. The length 19 of the cross-sectional constriction of the short circuit narrow section 10 may be 1.5±0.5 mm.

In further embodiments, the first and/or the second layer 7, 9 can be designed as a coating.

FIG. 1 shows that the first layer 7 is applied to the top side of the melting wire in the first section 5, at least substantially with a circular shape—as seen in cross section.

The second layer 9 can be applied to the outer shell surface 6 of the melting wire 3 at least substantially in a ring shape, encasing and/or surrounding the melting wire 3.

FIGS. 6*b* and 6*c* show the cross-sections of a further embodiment of the melting conductor 1, wherein both the first layer 7 and the second layer 9 have been applied in their respective sections 5 and 8 at least substantially completely sheathing and/or surrounding the outer shell surface 6 of the melting wire 3.

FIG. 6*a* shows that the melting wire 3 comprises an at least substantially rectangular cross-sectional shape. In the illustrated embodiment, the melting wire 3 is designed as a flat strip that can comprise a plurality of cross-sectional constrictions. Thereby, the melting wire 3 may comprise a strip thickness and/or height of 0.04±0.01 mm when designed as a flat strip. The maximum width 10 of the melting wire 3 can be 1.5±0.5 mm.

FIG. 6*a* shows in perspective how the recesses 13, 14 design the cross-sectional narrow sections of the overload narrow section 4 and the short circuit narrow section 10.

In further embodiments, it may alternatively be provided that the melting wire 3, the first and/or the second layer 7, 9 comprise an at least substantially circular outer cross-section.

It is not shown that the melting wire 3 comprises metal as material. The metal may be at least substantially pure silver. In particular, the silver comprises a degree of purity of 99.99%. The aforementioned degree of purity provides the proportion of Ag (silver) in the metal material. This is also referred to as fine silver.

In a further embodiment, it may be provided that the melting wire 3 comprises and/or consists of copper and/or a copper alloy as material.

It can be seen schematically from FIGS. 3 and 4 that the melting conductor 1 comprises an alternating sequence of directly successive overload narrow sections 4. Especially a sequence-like succession of the overload narrow sections 4 and especially of the short circuit narrow sections 10 arranged between the overload narrow sections 4 is provided. In the alternating sequence of the overload narrow sections 4, an at least substantially identical design of two directly successive overload narrow sections 4 and especially of the short circuit narrow sections 10 provided between the overload narrow sections 4 is especially provided. The overload narrow sections 4 are at least substantially regularly spaced in the embodiment example shown in FIG. 3 and comprise an at least substantially equal distance from one another. The "pattern" of the cross-sectional constrictions arranged between two second sections 8 shown in FIG. 1 and the respective shape of the cross-sectional constrictions corresponding thereto are thus provided especially repetitively along the longitudinal direction L of the melting wire 3.

The first section 5 in particular does not repeat, so that the melting conductor 1 as a whole comprises only at least one first layer 7; and in particular independently of the number of overload narrow sections 4. However, the second layer 9 is provided in particular adjacent to each overload narrow section 4.

In the embodiment example shown in FIG. 1, it is provided that the ratio of the maximum width 20 of the melting wire 3 to the minimum width 11, 12 of the cross-sectional constriction of the overload narrow section 4 and/or the cross-sectional constrictions of the short circuit narrow section 10 is between 1:0.4 to 1:0.35. In further embodiments, the aforementioned ratio may be between 1:0.6 to 1:0.2, thereby having any value within the specified interval.

In FIG. 2, a fuse 2 for fuse protection of a DC application is shown. Especially a high voltage high power DC fuse 2 is provided. The fuse 2 comprises an outer fuse box 21, wherein at least one melting conductor 1 wound around a winding body 22, in particular an electrically isolating winding body 22, is arranged in the fuse box 21 according to at least one of the embodiments described earlier.

It is not shown that a plurality of melting conductors 1 can also be wound around the winding body 22. The melting conductor 1 comprises a plurality of cross-sectional constrictions, wherein the design of the cross-sectional constrictions of the short circuit narrow sections 10 and the overload narrow sections 4 in combination with the first and second layers 7, 9 first enable the fuse 2 to be used as an HH-DC fuse 2.

FIG. 2 further shows that at least one contact cap 24 designed for electrical contacting is arranged on each end face of the fuse box 21.

FIGS. 7 and 8 show that the fuse 2 can be used to protect a direct current transmission, wherein in FIG. 7 the fuse 2 is arranged between a direct current source 27 and a consumer 29. The direct current transmitted to the consumer 29 flows through the fuse 2.

It is not shown that the fuse box 21 is designed to be at least substantially open at the two end faces 23.

FIGS. 3 and 5 show that the winding body 22 is designed to be at least substantially star-shaped. The star-shaped design of the winding body 22 is furthermore readily apparent from FIG. 5. The winding body 22 comprises—seen in cross-section—protrusions 25 and/or ridges, wherein recesses and/or depressions 26 are provided between the protrusions 25 and/or ridges. The protrusions 25 are thereby designed such that they can be used for at least substantially punctual support of the melting conductor 1. Between the protrusions 25, the melting conductor 1 does not rest on the surface of the winding body 22.

In the embodiment shown in FIGS. 7 and 8, the DC voltage of the DC current is greater than 1 kV and less than 100 kV. In further embodiments, the DC voltage may be between 1.5 kV to 50 kV or between 3 kV to 30 kV. In even more preferably embodiments, the rated voltage or the rated voltage range of the fuse 2 is greater than 1 kV and/or less than 100 kV and/or is between 1 kV to 100 kV, preferably between 1.5 kV to 50 kV.

Furthermore, in the case of the fuse 2 used in a DC network in FIGS. 7 and 8, it is provided that the smallest breaking current of the fuse 2 is 50 A±20 A. In even more preferably embodiments, the smallest breaking current of the fuse 2 may be greater than 3 A and/or less than 500 A and/or between 3 A to 700 A, preferably between 5 A to 500 A.

In further embodiments, the smallest breaking current of the fuse 2 can correspond to 1.5 times to 10 times the rated current, in particular wherein the minimum and/or smallest breaking current is directly dependent on the rated current of the respective fuse link.

The rated breaking capacity and/or the highest breaking current of the fuse 2 is greater than 1 kA and/or lies between 20 kA and 50 kA in the example shown in FIGS. 7 and 8.

The direct current source 27 shown in FIGS. 7 and 8 provides direct current with a current greater than 5 A. Especially, the current of the direct current and/or the rated current range is between 10 A to 75 kA.

As a function of the transmitted DC current and DC voltage, the product of the DC current and DC voltage protected by the fuse 2 may vary. In the embodiment example shown in FIGS. 7 and 8, the aforementioned product is 1000 kW±50 kW. In further embodiments, the product (mathematical multiplication) of the DC current and the DC voltage protected by the fuse 2 may be between 5 kW and 3000 MW, especially between 700 kW and 1000 MW.

Not shown is that a plurality of melting conductors 1 are arranged in the fuse box 3. In further embodiments, it may be provided that between 2 to 10 melting conductors 1 are used.

It is not shown that the DC application is a medium voltage DC application and/or a high voltage DC application. The medium voltage DC application comprises a DC voltage of up to 30 kV. A high voltage DC application comprises a DC voltage of more than 50 kV.

The fuse 2 may further be arranged to a medium voltage DC system, especially in a medium voltage DC system with at least one MVDC device.

Furthermore, it is not shown that the direct current source 27 is a photovoltaic system and/or photovoltaic area system (i.e., a solar farm) and/or a wind power system and/or a wind farm, especially an offshore wind farm. Especially, the aforementioned energy conversion plants provide direct current to the direct current grid. The power generated by the aforementioned power conversion plants can be transmitted to the consumer 29 in a secured manner by at least one fuse 2.

In addition, FIGS. 7 and 8 show a system 28 with a consumer 29 which can be supplied by direct current Especially the consumer 29 is an user and/or a plurality of consumers. Furthermore, the system 28 comprises a fuse 2 which is designed to protect the direct current transmitted to the consumer 29. It is not shown that the power of the consumer 29 is greater than 5 KW and less than 2000 MW. In particular, the fuse 2 is used in a direct current network.

FIG. 2 shows that the fuse box 21 is designed in the shape of a hollow cylinder and/or a tube. On the end face, the fuse box 21 is tightly enclosed by the contact caps 24, wherein the contact cap 24 can be placed on the fuse box 21.

FIG. 2 shows that the contact cap 24 covers at least part of the shell surface in the end region of the fuse box 21.

It is not shown that the contact cap 24 is associated to another top cap, which is placed in front of the contact cap 24 and at least partially covers the contact cap 24. In this case, the contact cap 24 represents the so-called inner auxiliary cap.

The fuse box 21 shown in FIG. 2 comprises a ceramic material. In further embodiments, the fuse box 21 can consist of a ceramic material. Alternatively or additionally, the fuse box 21 may comprise a plastic material, especially a gas fiber reinforced plastic material.

It is not shown that an extinguishing agent is provided in the fuse box 21. The extinguishing agent may be an extinguishing sand filling, preferably quartz sand, and/or air.

FIG. 4 shows that the melting conductor 1 is connected to the contact cap 24 in an electrically contacting manner.

It is not shown that the melting conductor 1 is at least partially, in particular completely, embedded in and/or surrounded by the extinguishing agent. In particular, the melting conductor 1 comprises an arc extinguishing agent by the design of the second layer 9 and/or by the material of the second layer 9.

Moreover, it is not shown that the fuse box 21 is at least substantially hermetically encapsulated.

The material for the winding body 22 may be hard porcelain.

In further embodiments, the winding body 22 may be designed such that a plurality of chambers is formed, in particular wherein a cross-sectional constriction is provided in one chamber.

Further not shown is that the contact cap 24 comprises a galvanic coating and/or a silver coating and/or comprises and/or consists of electrolyte copper and/or aluminum as material.

LIST OF REFERENCE SIGNS

1 Melting conductor
2 Fuse
3 Melting wire
4 Overload narrow section
5 First section
6 Outer shell surface of 3
7 First layer
8 Second section
9 Second layer
10 Short circuit narrow section
11 Minimum width of 4
12 Minimum width of 10
13 Recess of 4
14 Recess of 10
15 Distance between two short circuit narrow sections
16 Distance between short circuit narrow section and overload narrow section

17 Distance between cross-section constrictions
18 Length from 4
19 Length of 10
20 Maximum width of 3
21 Outer fuse box
22 Winding body
23 End face
24 Contact cap
25 Protrusion of 22
26 Depression of 22
27 Direct current source
28 System
29 Consumer
L Longitudinal direction

The invention claimed is:

1. A melting conductor for one or more of a DC fuse and a high-voltage high-power DC fuse (HH-DC fuse), wherein the melting conductor comprises:

an electrically conductive melting wire, wherein the melting wire comprises at least two overload narrow sections, the at least two overload narrow sections being respective cross-sectional constrictions, wherein, between the at least two overload narrow sections in at least one first section, there is at least one first layer comprising solder which at least partially surrounds the outer shell surface of the melting wire circumferentially, wherein a second layer, which is a coating, surrounds the outer shell surface of the melting wire circumferentially, the second layer adjacent to each of the overload narrow sections in a respective second section, and wherein the melting wire further comprises between the at least two overload narrow sections at least one short circuit narrow section that is a cross-sectional constriction, wherein a rated minimum interrupting current of the fuse is between greater than 3 times a rated current of the fuse, and less than 8 times the rated current.

2. The melting conductor of claim 1, wherein one or more of minimum width and the shape of the cross-sectional constriction of the overload narrow section differs from one or more of the minimum width and the shape of the cross-sectional constriction of the short circuit narrow section.

3. The melting conductor of claim 1, wherein a minimum width of the cross-sectional constriction of the overload narrow sections is greater than the minimum width of the cross-sectional constriction of the short circuit narrow section, wherein a ratio of the minimum width of the cross-sectional constriction of the overload of narrow sections to the minimum width of the cross-sectional constriction of the short circuit narrow section is between 1.01:1 and 3:1.

4. The melting conductor of claim 1, wherein one or more of: the second layer is at least substantially directly adjacent to the respective overload narrow section and the second layer is firmly connected to the outer shell surface of the melting wire.

5. The melting conductor of claim 1, wherein the second layer comprises a plastic and/or poly(organo)siloxane, wherein the second layer is electrically insulating.

6. The melting conductor of claim 1, wherein the solder of the first layer comprises a metal alloy, wherein the metal alloy comprises cadmium, lead, tin, zinc, silver and/or copper, and wherein the first layer is electrically conductive.

7. The melting conductor of claim 1, wherein one or more of: a plurality of short circuit narrow sections are provided between two directly successive overload sections, and the first section comprising the first layer, that is on the outer shell surface of the melting wire, is arranged between two directly successive short circuit narrow sections.

8. The melting conductor of claim 1, wherein the second sections, which comprise the second layer, are arranged on the outer shell surface of the melting wire such that one or more of:

there are the two overload narrow sections and the short circuit narrow sections, the short circuit narrow sections are arranged between two directly successive second sections, and more than one second layer is provided.

9. The melting conductor of claim 1, wherein the at least two overload narrow sections are formed by recesses comprising an at least substantially rectangular edge.

10. The melting conductor of claim 1, wherein the short circuit narrow section is formed by recesses comprising an at least substantially circular arc section-shaped edge.

11. The melting conductor of claim 1, wherein one or more of:

short circuit narrow sections arranged between the overload narrow sections are at least substantially regularly spaced, a distance between two directly adjacent short circuit narrow sections and/or a distance between a short circuit narrow section and a directly adjacent overload narrow section are at least substantially regularly spaced, and a distance between a cross-sectional constriction of the short circuit narrow section and/or the overload narrow section and an immediately neighboring cross-sectional constriction of the short circuit narrow section and/or the overload narrow section is substantially the same.

12. The melting conductor of claim 1, wherein a length of the cross-sectional constriction of the overload narrow section is greater than a length of the cross-sectional constriction of the short-circuit narrow section.

13. The melting conductor of claim 1, wherein the first layer is a coating.

14. The melting conductor of claim 1, wherein one or more of: the melting wire comprises an at least substantially rectangular cross-sectional shape, is formed as a flat strip, and one or more of the melting wire, the first and the second layer have an at least substantially circular outer cross-section.

15. The melting conductor of claim 1, wherein the melting wire comprises metal, wherein the metal comprises one or more of: at least substantially pure silver, a silver alloy, copper, and a copper alloy.

16. The melting conductor of claim 1, wherein the melting conductor comprises an alternating sequence of directly successive overload narrow sections, with short circuit narrow sections arranged between two directly successive overload narrow sections, wherein the overload narrow sections are at least substantially regularly spaced.

17. The melting conductor of claim 1, wherein a ratio of a maximum width of the fuse wire to a minimum width of the cross-sectional constriction of the overload narrow section and/or the cross-sectional constriction of the short circuit narrow section is between 1:0.6 and 1:0.2.

18. The melting conductor of claim 1, wherein the melting conductor is in the HH-DC fuse adapted for fuse protection of a DC transmission having an outer fuse box, wherein at least one melting conductor wound around an electrically insulating winding body is arranged in the fuse box.

19. The melting conductor of claim 18, wherein the fuse box is at least partially open at two end faces, wherein at least one contact cap configured for electrical contacting is arranged on an end face of the fuse box.

20. The melting conductor of claim 18, wherein the DC voltage of the DC current and/or the rated voltage of the fuse is greater than 1 kV.

21. The melting conductor of claim 18, wherein the rated minimum interrupting current smallest of the fuse is greater than 3 A.

22. The melting conductor of claim 18, wherein a rated breaking capacity is greater than 1 kA.

23. The melting conductor of claim 18, wherein transmitted direct current and/or a rated current range is greater than 5 A.

24. The melting conductor of claim 18, wherein a product of a direct current and a direct voltage protected by the fuse is greater than 5 kW.

25. A system having a consumer which can be supplied by direct current, having at least one fuse in accordance with claim 18, wherein a direct current transmitted to the consumer can be protected by the fuse, wherein a power of the consumer is greater than 5 kW.

* * * * *